US007353759B2

(12) United States Patent
Gray

(10) Patent No.: US 7,353,759 B2
(45) Date of Patent: Apr. 8, 2008

(54) SIDEFRAME WITH ADAPTERS TO CONNECT SURFACE BRACKETS

(75) Inventor: James A. Gray, St. Louis, MO (US)

(73) Assignee: ASF-Keystone, Inc., Granite City, IL (US)

( * ) Notice: Subject to any disclaimer, the term of this patent is extended or adjusted under 35 U.S.C. 154(b) by 234 days.

(21) Appl. No.: 11/303,894

(22) Filed: Dec. 19, 2005

(65) Prior Publication Data

US 2007/0137516 A1 Jun. 21, 2007

(51) Int. Cl.
*B61F 3/00* (2006.01)

(52) U.S. Cl. ..... 105/206.1

(58) Field of Classification Search ..... 105/182.1, 105/198.2, 205, 206.1, 206.2
See application file for complete search history.

(56) References Cited

U.S. PATENT DOCUMENTS 1,652,002 A * 12/1927 Doerr ..... 105/205
1,760,181 A * 5/1930 Stertzbach et al. ..... 105/206.1
1,765,007 A * 6/1930 Dreibuss ..... 105/205
1,843,065 A * 1/1932 Couch ..... 105/205
4,363,276 A 12/1982 Neumann
4,838,174 A 6/1989 Moehling
5,410,968 A * 5/1995 Hawthorne et al. ..... 105/206.1
5,481,986 A * 1/1996 Spencer et al. ..... 105/206.1
5,718,177 A 2/1998 Wronkiewicz et al.
6,125,767 A 10/2000 Hawthorne et al.
6,543,367 B1 * 4/2003 Stecker et al. ..... 105/206.1

* cited by examiner

*Primary Examiner*—Lars A. Olson
(74) *Attorney, Agent, or Firm*—Edward J. Brosius

(57) ABSTRACT

The present invention provides a sideframe for use in a traditional three piece railway fright car truck comprising a pair of laterally spaced sideframes supporting a bolster extending between the sideframes. Each sideframe comprises an elongated top compression member, two diagonal compression members extending generally downwardly at acute angles from near the ends of the top compression member, and a bottom member joining the other ends of the diagonal tension members. Two column members also extend vertically between the bottom member and the top compression member. Pads with fastener openings are provided on the top surface of the top compression member to assist in mounting brackets to the sideframe.

19 Claims, 2 Drawing Sheets

SIDEFRAME WITH ADAPTERS TO CONNECT SURFACE BRACKETS

BACKGROUND OF THE INVENTION

The present invention relates to railway freight car trucks and, more particularly, to railway freight car truck sideframes having an improved pad arrangement on the top surface of the top compression member.

Railway freight car trucks are usually comprised of a three piece arrangement wherein each truck includes two sideframes laterally spaced from each other. Each sideframe includes a centrally located opening formed by vertical columns. Such centrally located opening is usually referred to as the bolster opening or pocket and is adapted to receive the ends of a bolster extending laterally from and perpendicular to the sideframes. The ends of each sideframe are laterally aligned to receive an axle wheel set in what is usually termed the pedestal jaw of the sideframe.

A typical railway freight car truck sideframe is comprised of an elongated top compression member that extends in a longitudinal direction parallel to the railway track. The sideframe also comprises two diagonally extending tension members that extend generally downwardly at an acute angle from near the ends of the top compression member. A bottom member extends longitudinally and joins the lower ends of the diagonal tension members. Column members extend generally vertically between the bottom member and the top compression member from a point near the junction of the diagonal tension members and the bottom member. Such column members form the bolster opening in the sideframe. A top portion of the bottom member of a sideframe is usually referred to as the spring seat of the sideframe as it is adapted to receive the spring group upon which the ends of the bolster are supported. The bolster extends laterally between each sideframe with the ends of the bolster extending into the bolster pockets and supported on a spring group. Side sections join the top compression member and the tension members.

It should be understood that the sideframe is an engineered structural member that is largely hollow to accomplish weight saving. It should also be understood that the sideframe is a unitary cast steel structure made in a foundry casting operation. Accordingly, it is possible to strengthen the sideframe by the addition of various supporting structures that would become part of the unitary sideframe. However, such addition of strengthening members is always balanced against the need for lighter weight freight car trucks. It is desirable to provide the top surface of the top compression member with pad to provide for the attachment of contact plates or brackets to the sideframe. Such brackets are welded onto the sideframe, leaving open the possibility of failure and loss of the bracket.

Accordingly, it is an object of the present invention to provide an improved railway truck sideframe with cast in pads to allow the connection of contact plates or brackets.

It is another object of the present invention to provide a railway truck sideframe having an improved structure thereby particularly providing surface contact pads to allow the connection of contact plates or brackets to the sideframe.

SUMMARY OF THE INVENTION

The present invention provides an improved top compression member of a railway truck sideframe. Each sideframe of a railway car truck is formed in a unitary cast steel structure. Each sideframe includes an elongated top compression member that extends longitudinally and parallel to the railway tracks. Two end sections each extend longitudinally from each end of the top compression member and form pedestal jaws adapted to receive the axle bearing end of the wheel sets. Two diagonal tension members extend generally downwardly from near the end of the top compression member at an acute angle to the top compression member. A bottom member extends longitudinally and joins the lower ends of the diagonal members. Two column members are longitudinally spaced from each other and extend vertically between the bottom member and top compression member. The column members form the bolster opening or pocket of each sideframe. The top surface of the bottom member is referred to as the spring seat and is adapted to receive the spring group upon which the end of the bolster is supported.

Each column is a generally structural member having a cross section comprised of the main section extending laterally across the width of the column member. Two wearplate support sections protrude longitudinally inwardly toward the bolster opening from lateral ends of the main section of the column member. Two sidewalls protrude longitudinally outwardly away from the bolster opening from lateral ends of the main section of the column member.

The top compression member includes pads on its top outer surface. Such pads may be individual raised surfaces or an elongated, lateral surface. Each car has one or two fastener openings that extend through the pad and through the top compression member. Further, side fastener openings extend through the sidewalls of each sideframe.

DETAILED DESCRIPTION

A typical railway truck in accordance with the present invention comprises two sideframes 12 that are identical and are laterally spaced from each other. Axle wheel sets (not shown) are received in pedestal openings 27 and 29 formed at respective end sections 26 and 28 of each sideframe, a bolster (not shown) extends laterally between the sideframes and is received in bolster openings 40 intermediate the pedestal ends of both sideframes.

Figure 1:
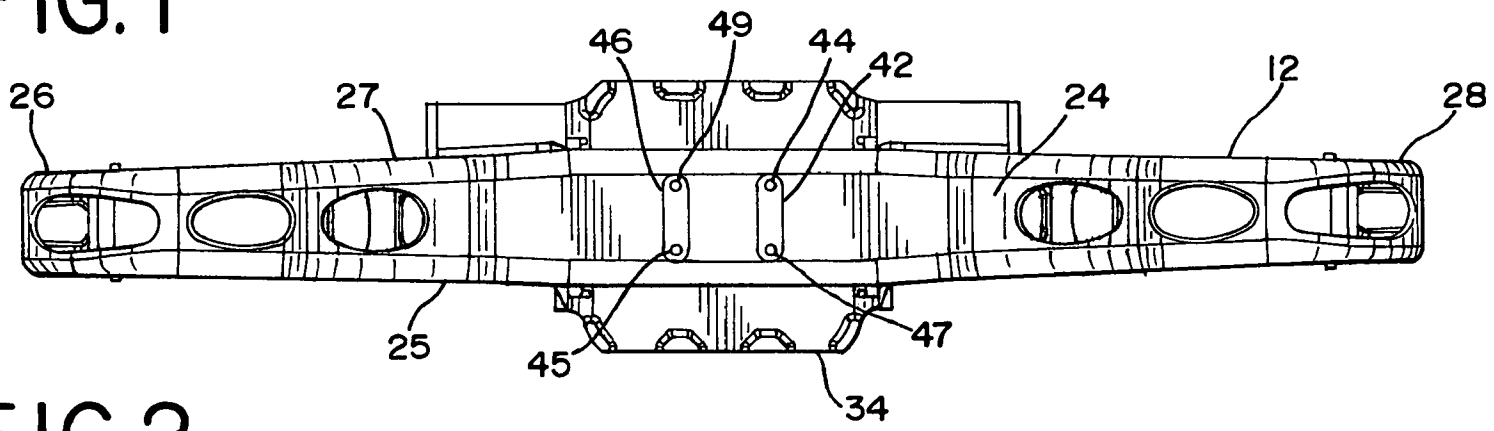
FIG. 1 is a top view of a railway truck sideframe in accordance with an embodiment of the present invention.
Figure 2:
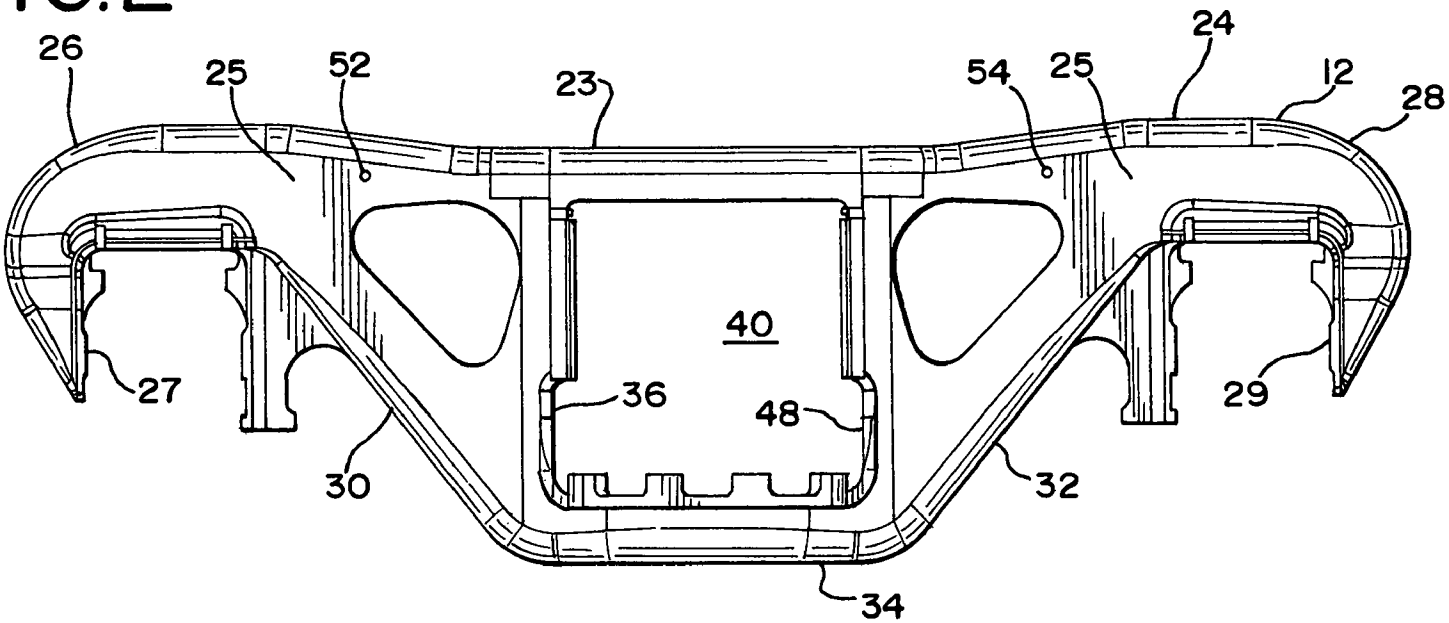
FIG. 2 is a side view of a sideframe in accordance with an embodiment of the present invention.

Referring now to FIGS. 1 and 2 of the drawings, sideframe 12 is comprised of an elongated top compression member 24 that runs longitudinally across the top part of sideframe 12 and ends in end sections 26 and 28. It is seen that pedestal opening 27 is formed at a lower portion of end section 26 and pedestal opening 29 is formed at a lower portion of section 28. Diagonal tension members 30 and 32 extend downwardly from top compression member 24 at a point near end sections 26 and 28. The angle at which diagonal tension members 30 and 32 extend is about 45 degrees. Bottom section 34 extends longitudinally and joins the lower end sections of diagonal tension members 30 and 32. Column member 36 and 38 are spaced longitudinally from each other and extend vertically from an upper portion of bottom section 34 near its junction with diagonal tension members 30 and 32 to a lower surface of top compression member 24. It is seen that the combination of the lower portion of top compression member 24, the upper portion of bottom section 34 and column members 36 and 48 form a generally rectangular bolster opening 40. The upper surface of bottom section 34 is also referred to as spring seat 42.

It should be understood that sideframe 12 is a unitary cast steel structure. Such structures are cast in accordance with modern foundry practice that includes the use of cores to form the structural components of sideframe 12 in a generally hollow fashion such that each structural component such as top compression member 24 and bottom section 34 are generally hollow, each comprised of a bottom section and a top section and two side sections joined to the top and bottom sections. Top compression member 24 includes side sections 25 and 27.

Pad section 42 is seen to be located on top surface 23 of top compression member 24. Pad section 42 is either even with or slightly raised from top surface 23, and extends laterally across a majority of the width of top surface 23. Two laterally spaced fastener openings 44 and 47 extend through pad section 42 and top compression member 24.

Pad section 46 is longitudinally spaced from pad section 42, but it is similar to pad section 42 and includes laterally spaced fastener openings 45 and 49.

Side section 25 includes side fastener openings 52 and 54, which are longitudinally spaced and extend through side section 25. Side section 27 includes similar side fastener openings that are aligned with openings 52 and 54, but are not shown.

Figure 3:
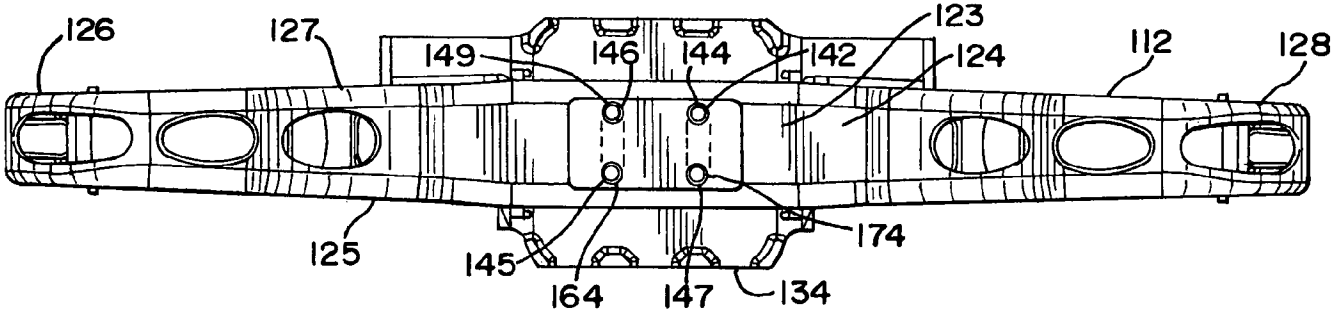
FIG. 3 is a top view of a sideframe in accordance with another embodiment of the present invention.

Referring to FIG. 3 of the drawings, a second embodiment of the present invention is shown. Sideframe 112 is comprised of a longitudinal elongated top compression member 24 that runs longitudinally across the top part of sideframe 112 and ends in end section 126 and 128.

It should be understood that sideframe 112 is a unitary cast steel structure. Such structures are cast in accordance with modern foundry practice that includes the use of cores to form the structural components of sideframe 112 in a generally hollow fashion such that each structural component such as top compression member 124 and bottom section 134 are generally hollow, each comprised of a bottom section and a top section and two side sections joined to the top and bottom sections. Top compression member 124 includes side sections 125 and 127.

Pad section 142 is seen to be located in top surface 123 of top compression member 124. Pad section 142 is either even with or slightly raised from top surface 123, and has fastener opening 144 extending through pad section 142 and top compression member 124.

Pad section 147 is similar to pad section 142, is spaced laterally therefrom and has fastener opening 174 extending through pad section 147 and top compression member 124.

Pad section 146 is longitudinally spaced from pad section 142, is similar to pad section 142 and has fastener opening 149 extending through pad section 146 and top compression member 124.

Pad section 145 is similar to pad section 146, is spaced laterally therefrom and has fastener opening 164 extending through pad section 145 and top compression member 124.

Figure 4:
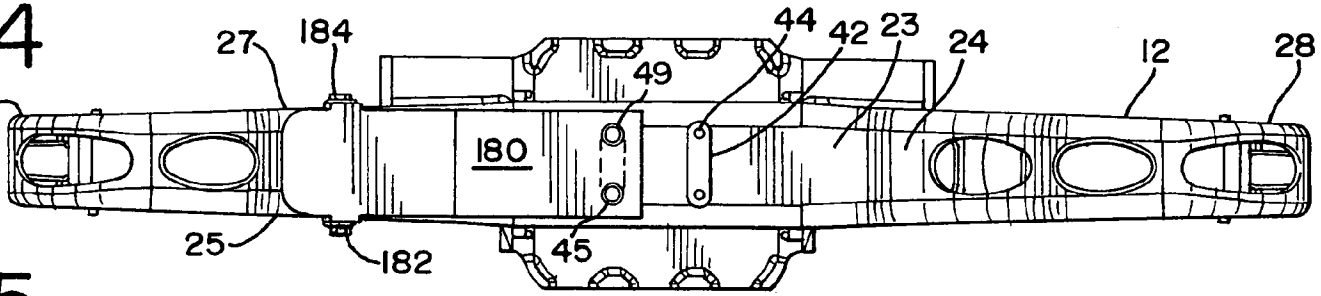
FIG. 4 is a top view of a sideframe in accordance with the first embodiment of the present invention with a bracket installed.
Figure 5:
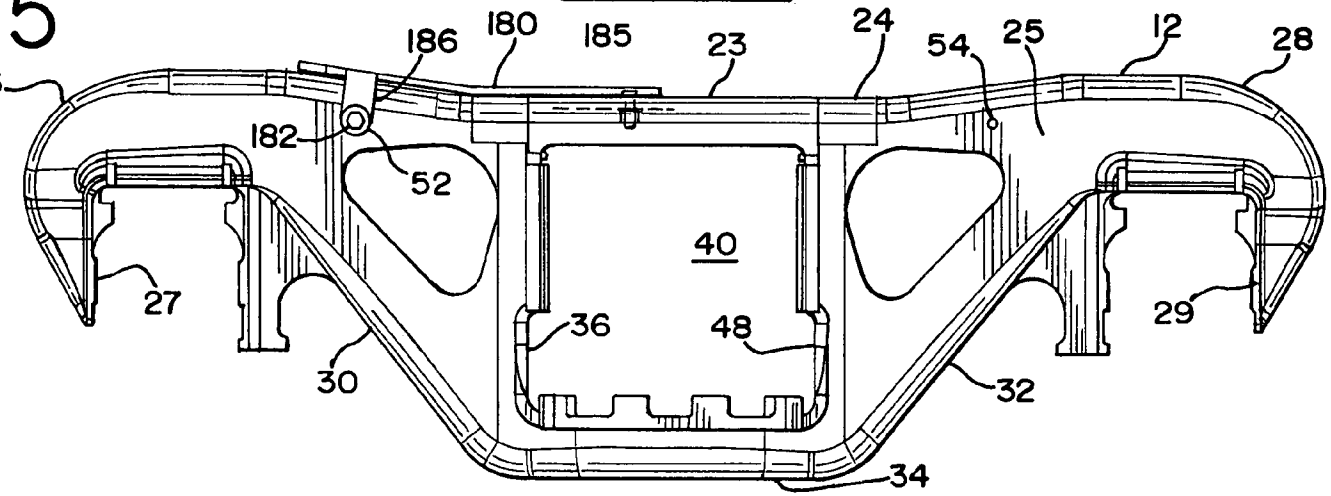
FIG. 5 is side view of a sideframe in accordance with the first embodiment of the present invention with a bracket installed.

Referring now to FIGS.4 and 5, sideframe 12 is shown with bracket 180 mounted thereto. Side bolt 182 extends into side fastener opening 52 in side section 25, and side bolt 184 extends into the side fastener opening (not shown) in side section 27 aligned with side fastener opening 52.

Bracket 180 is seen to be generally rectangular, with a configuration complementary to that of top surface 23 of top compression member 24. Top bolt 185 extends into fastener opening 45 in top surface 23, and another fastener bolt (not shown) extends into fastener opening 49 in top surface 23.

What is claimed is:

1. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension members each extending at an acute angle with said top compression member from near said end of said top compression member, a bottom member extending longitudinally and joining said diagonal tension members at a lower end of each diagonal tension member, two column members longitudinally spaced from each other extending vertically between said bottom member and said top compression member, said column member forming a bolster opening between, the top compression member including two elongated longitudinally spaced generally flat pad sections, each of which extending laterally across a majority of the lateral width of the top compression member, each of the pad sections having fastener openings extending through the pad section and the top compression member, further including two side sections each extending between the top compression member and the diagonal tension members, and a side fastener opening extending through each side section below the top compression member.

2. The sideframe of claim 1, wherein each side section includes two side fastener openings, the side fastener openings in each side section being spaced longitudinally from each other.

3. The sideframe of claim 1, wherein each side section includes two side fastener openings in each side section being located above the diagonal tension member.

4. The sideframe of claim 1, wherein the side fastener openings extending through the side sections are aligned.

5. The sideframe of claim 1, wherein the pad sections are located above the bolster opening.

6. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension members each extending at an acute angle with said top compression member form near said end of said top compression member, a bottom member extending longitudinally and joining said diagonal tension members at a lower end of each diagonal tension member, two column members longitudinally spaced from each other extending vertically between said bottom member and said top compression member, said column member forming a bolster opening between, the top compression member including longitudinally spaced, generally flat pad sections, each of the pad sections having a fastener opening extending through the pad section and the top compression member, further including two side sections each extending between the top compression member and the diagonal tension members, and a side fastener opening extending through each side section below the top compression member.

7. The sideframe of claim 6, wherein each pad section is raised above a top surface of the top compression member.

8. The sideframe of claim 6, wherein the longitudinally spaced pad sections are provided in laterally spaced pairs.

9. The sideframe of claim 6, wherein each of the pad sections extends laterally across a majority of the lateral width of the top compression member.

10. The sideframe of claim 6, wherein each of the pad sections has two laterally spaced fastener openings extending through the pad section and the top compression member.

11. The sideframe of claim 6, wherein the pad sections are located above the bolster opening.

12. The sideframe of claim 6, wherein the pad sections are located above the bolster opening.

13. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension member each extending at an acute angle with said top compression member form near said end of said top compression member, a bottom member extending longitudinally and joining said diagonal tension members at a lower end of each diagonal tension member, two column members longitudinally spaced from each other extending vertically between said bottom member and said top compression member, said column member forming a bolster opening between, the top compression member including two elongated, longitudinally spaced, generally flat pad sections each of which extending across a majority of the lateral width of the top compression member, each of the pad sections having two laterally spaced fastener openings extending through the pad section and the top compression member, and two side sections each extending between the top compression member and the diagonal tension members, and a side fastener opening extending through each side section below the top compression member.

14. The sideframe of claim 13, wherein each side section includes two side fastener openings, the fastener openings in each side section being spaced longitudinally from each other.

15. The sideframe of claim 13, wherein each side section includes two side fastener openings, the side fastener openings in each side section being located above the diagonal tension member.

16. The sideframe of claim 13, wherein the side fastener openings extending through the side sections are aligned.

17. The sideframe of claim 13, wherein the pad sections are located above the bolster opening.

18. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension members each extending at an acute angle with said top compression member form near said end of said top compression member, a bottom member extending longitudinally and joining said diagonal tension members at a lower end of each diagonal tension member, two column members longitudinally spaced from each other extending vertically between said bottom member and said top compression member, said column member forming a bolster opening between, the top compression member including longitudinally spaced, generally flat pad sections, each of the pad sections having a fastener opening extending through the pad section and top compression member, wherein each side section includes two side fastener openings, the side fastener openings in each side section being spaced longitudinally from each other.

19. A sideframe for use in a railway car truck, said sideframe of a generally unitary cast steel structure comprising an elongated top compression member extending longitudinally, two end sections each extending longitudinally from an end of said top compression member and each forming a pedestal jaw, two diagonal tension members each extending at an acute angle with said top compression member form near said end of said top compression member, a bottom member extending longitudinally and joining said diagonal tension members at a lower end of each diagonal tension member, two column members longitudinally spaced from each other extending vertically between said bottom member and said top compression member, said column member forming a bolster opening between, the top compression member including longitudinally spaced, generally flat pad sections, each of the pad sections having a fastener opening extending through the pad section and the top compression member, wherein each side section includes two side fastener openings, the said side fastener openings in each side section being located above the diagonal tension member.

* * * * *